US008096413B2

(12) United States Patent
Coltri De Paula

(10) Patent No.: US 8,096,413 B2
(45) Date of Patent: Jan. 17, 2012

(54) PACKAGE FOR CONTAINERS

(75) Inventor: Andrea Coltri De Paula, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/711,555

(22) Filed: Feb. 24, 2010

(65) Prior Publication Data

US 2010/0264043 A1 Oct. 21, 2010

Related U.S. Application Data

(60) Provisional application No. 61/208,462, filed on Feb. 24, 2009.

(51) Int. Cl.
*B65D 75/00* (2006.01)

(52) U.S. Cl. ..... 206/153; 206/158; 206/199

(58) Field of Classification Search ..... 206/153, 206/158, 151, 149, 147, 152, 145, 199, 197; 229/120.32

See application file for complete search history.

(56) References Cited

U.S. PATENT DOCUMENTS

| | | | | |
|---|---|---|---|---|
| 1,527,399 | A | 2/1925 | Davidson | |
| 2,289,859 | A | 7/1942 | Arthur | |
| 2,522,950 | A | 9/1950 | Keith | |
| 2,798,603 | A | 7/1957 | Grinspoon | |
| 2,950,041 | A | 8/1960 | Stone | |
| 3,137,109 | A * | 6/1964 | Rapata | 53/398 |
| 3,528,697 | A | 9/1970 | Wood | |
| 3,601,439 | A * | 8/1971 | Poupitch | 294/87.2 |
| 3,627,121 | A * | 12/1971 | Deasy | 206/151 |
| 3,897,873 | A | 8/1975 | Graser | |
| 3,942,631 | A | 3/1976 | Sutherland et al. | |
| 4,029,204 | A | 6/1977 | Manizza | |
| 4,304,329 | A | 12/1981 | Graser | |
| 4,372,599 | A | 2/1983 | Kiedaisch et al. | |
| 4,378,879 | A | 4/1983 | Killy | |
| 4,382,505 | A | 5/1983 | Sutherland et al. | |
| 4,784,266 | A | 11/1988 | Chaussadas | |
| 5,139,147 | A | 8/1992 | Sutherland | |
| 5,188,225 | A | 2/1993 | Jorba | |
| 5,246,113 | A * | 9/1993 | Schuster | 206/430 |

(Continued)

FOREIGN PATENT DOCUMENTS

JP 2003-146359 5/2003

OTHER PUBLICATIONS

International Search Report and Written Opinion for PCT/US2010/041661, dated Mar. 1, 2011.

(Continued)

*Primary Examiner* — David Fidei

(74) *Attorney, Agent, or Firm* — Womble Carlyle Sandridge & Rice, LLP

(57) ABSTRACT

A package for holding a plurality of containers. The package comprises panels that extend at least partially around an interior of the package. The panels comprise a top panel and at least one side panel foldably connected to the top panel. At least one feature is in the top panel that receives and holds a top portion of at least one container of the plurality of containers. The at least one feature comprises an opening in the top panel and a retention feature adjacent the opening to engage at least one container of the plurality of containers to at least partially attach the at least one container to the package.

28 Claims, 13 Drawing Sheets

U.S. PATENT DOCUMENTS

| | | | | | |
|---|---|---|---|---|---|
| 5,267,644 | A | | 12/1993 | Tsao | |
| 5,297,673 | A | | 3/1994 | Sutherland | |
| 5,310,050 | A | | 5/1994 | Sutherland | |
| 5,310,051 | A | | 5/1994 | Sutherland | |
| 5,318,178 | A | * | 6/1994 | Davies et al. | 206/151 |
| 5,323,895 | A | | 6/1994 | Sutherland et al. | |
| 5,328,024 | A | | 7/1994 | Sutherland | |
| 5,351,815 | A | | 10/1994 | Fogle et al. | |
| 5,351,816 | A | | 10/1994 | Sutherland et al. | |
| 5,351,817 | A | | 10/1994 | Sutherland | |
| 5,355,999 | A | * | 10/1994 | Sutherland | 206/153 |
| 5,360,104 | A | | 11/1994 | Sutherland | |
| 5,390,784 | A | | 2/1995 | Sutherland | |
| 5,407,065 | A | | 4/1995 | Sutherland | |
| 5,415,278 | A | | 5/1995 | Sutherland | |
| 5,443,153 | A | | 8/1995 | Sutherland | |
| 5,445,262 | A | | 8/1995 | Sutherland | |
| 5,452,799 | A | | 9/1995 | Sutherland | |
| 5,503,267 | A | | 4/1996 | Sutherland | |
| 5,520,283 | A | | 5/1996 | Sutherland | |
| 5,524,756 | A | | 6/1996 | Sutherland | |
| 5,551,566 | A | | 9/1996 | Sutherland | |
| 5,553,705 | A | * | 9/1996 | Bakx | 206/158 |
| 5,593,027 | A | | 1/1997 | Sutherland | |
| 5,706,936 | A | * | 1/1998 | Bernstein | 206/147 |
| 5,711,419 | A | * | 1/1998 | Beales et al. | 206/148 |
| 5,746,310 | A | | 5/1998 | Slomski | |
| 5,791,463 | A | | 8/1998 | Negelen | |
| 5,816,391 | A | | 10/1998 | Harris | |
| 5,960,945 | A | * | 10/1999 | Sutherland | 206/158 |
| 6,039,181 | A | * | 3/2000 | Whiteside | 206/428 |
| 6,059,099 | A | | 5/2000 | Galbierz | |
| 6,315,111 | B1 | | 11/2001 | Sutherland | |
| 6,394,272 | B1 | * | 5/2002 | Domansky | 206/434 |
| 6,896,130 | B2 | | 5/2005 | Theelen | |
| 7,011,209 | B2 | | 3/2006 | Sutherland et al. | |
| 2002/0195371 | A1 | | 12/2002 | Brown | |
| 2003/0080004 | A1 | | 5/2003 | Olsen et al. | |
| 2003/0213705 | A1 | | 11/2003 | Woog | |
| 2005/0127151 | A1 | | 6/2005 | Johnson | |
| 2009/0101526 | A1 | | 4/2009 | Sutherland et al. | |
| 2009/0127147 | A1 | | 5/2009 | Sutherland | |

OTHER PUBLICATIONS

International Search Report and Written Opinion—PCT/US2008/080279 mailed Dec. 18, 2008—Graphic Packaging International, Inc. (applicant).

International Search Report for PCT application No. PCT/US2010/025178, mailed Sep. 2, 2010.

Written Opinion for PCT application No. PCT/US2010/025178, mailed Sep. 2, 2010.

International Search Report and Written Opinion—PCT/2009/061594, mailed Feb. 5, 2010—Graphic Packaging International, Inc. (applicant).

* cited by examiner

PACKAGE FOR CONTAINERS

CROSS-REFERENCE TO RELATED APPLICATION

This application claims the benefit of U.S. Provisional Application No. 61/208,462 which was filed on Feb. 24, 2009.

INCORPORATION BY REFERENCE

The entire contents of U.S. Provisional Application No. 61/208,462, which was filed on Feb. 24, 2009, in hereby incorporated by reference for all purposes.

BACKGROUND OF THE DISCLOSURE

The present disclosure generally relates to packages or cartons for holding and carrying containers.

SUMMARY OF THE DISCLOSURE

In general, one aspect of the disclosure is generally directed to a package for holding a plurality of containers. The package has a top panel and a side panel. The package has retention features for retaining the containers.

In another aspect, the disclosure is generally directed to a package for holding a plurality of containers. The package comprises panels that extend at least partially around an interior of the package. The panels comprise a top panel and at least one side panel foldably connected to the top panel. At least one feature is in the top panel that receives and holds a top portion of at least one container of the plurality of containers. The at least one feature comprises an opening in the top panel and a retention feature adjacent the opening to engage at least one container of the plurality of containers to at least partially attach the at least one container to the package.

In another aspect, the disclosure is generally directed to a blank for forming a package for holding a plurality of containers. The blank comprises panels that comprise a top panel and at least one side panel foldably connected to the top panel. The panels are for forming an interior of the package formed from the blank. At least one feature is in the top panel that is for receiving and holding a top portion of at least one container of the plurality of containers in the package formed from the blank. The at least one feature comprises an opening in the top panel and a retention feature adjacent the opening for engaging the at least one container of the plurality of containers to at least partially attach the at least one container to the package.

In another aspect, the disclosure is directed to a method of forming a package for containing a plurality of containers. The method comprises providing a blank having a top panel and at least one side panel foldably connected to the top panel, at least one feature in the top panel that comprises an opening in the top panel and a retention feature adjacent the opening. The method comprises inserting at least a top portion of a container through the opening and engaging the top portion of the container with the retention feature to at least partially attach the container to the package.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION OF THE EXEMPLARY EMBODIMENTS

The present disclosure generally relates to constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, aluminum and/or other metals, plastics such as PET, LDPE, LLDPE, HDPE, PP, PS, PVC, EVOH, and Nylon; and the like; glass; or any combination thereof.

Packages according to the present disclosure can accommodate containers of numerous different shapes. For the purpose of illustration and not for the purpose of limiting the scope of the disclosure, the following detailed description describes beverage containers (e.g., generally cylindrical containers such as aluminum cans) at least partially disposed within the package embodiments. In this specification, the terms "lower," "bottom," "upper" and "top" indicate orientations determined in relation to fully erected packages.

The present embodiments are addressed to cartons or packages for attachment to and accommodation of containers. A package or carrier 5 of a first embodiment is illustrated in its erected state in FIG. 3, in which it is attached to containers C arranged in two rows of three containers. In the illustrated embodiments the containers C are illustrated as beverage containers having a lower base portion B, a top portion T generally comprising a neck N that tapers inwardly from the lower base portion, a flange portion F at the top of the neck portion that extends radially outward from the neck portion, and a top surface TS below the flange portion that includes a pull-tab P. Containers of other sizes, shapes, and configurations, may be held in the package 5 without departing from the disclosure. The neck N and flange F of the containers C are received in respective openings 7 in the package 5 and retained in the package by retaining features described further herein. The containers C could be arranged in other than a 2×3 arrangement (e.g., 2×4, 2×6, 1×3, 1×4, etc.) and the package 5 could include more or less than six containers without departing from the disclosure.

Figure 1:
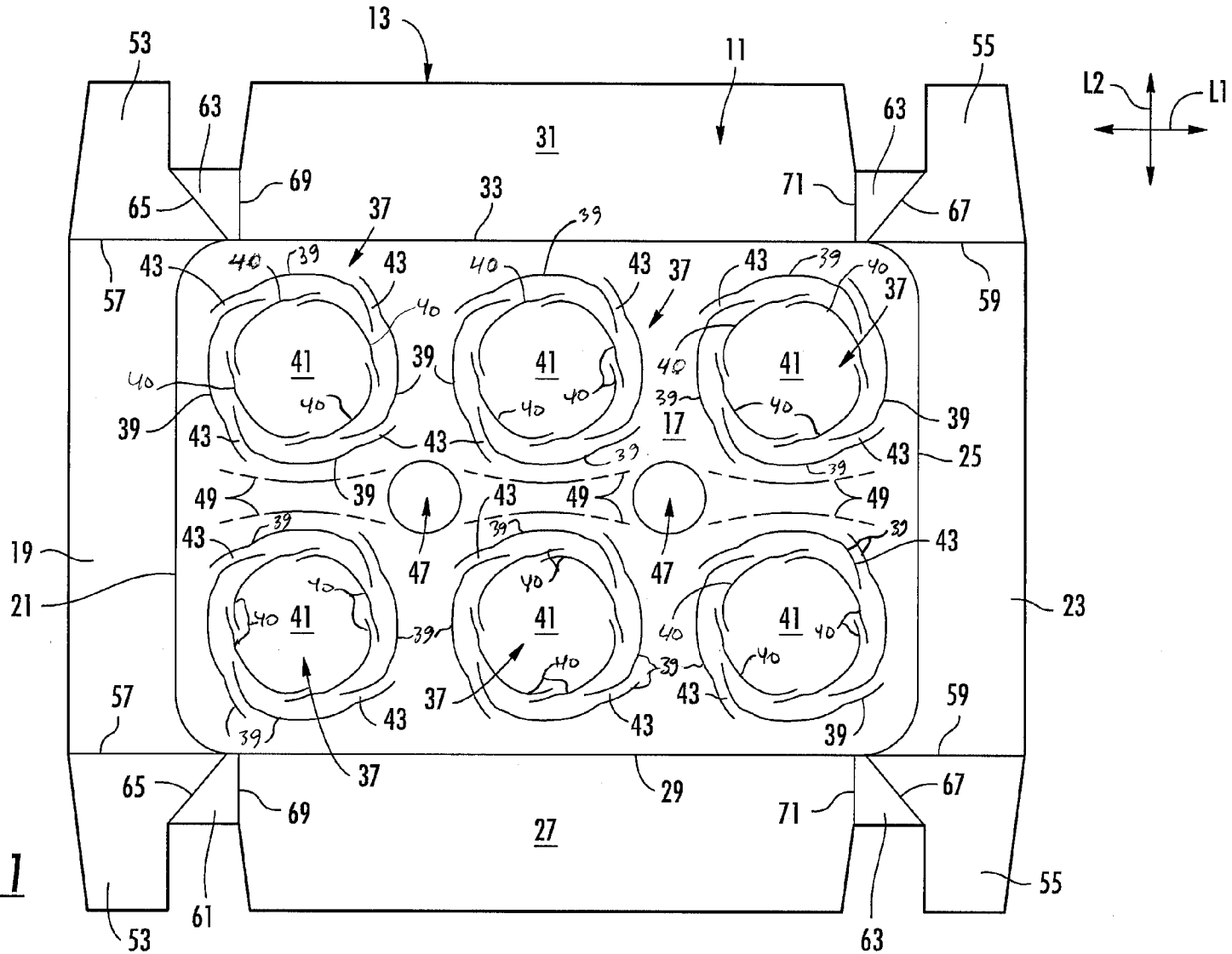
FIGS. 1-4 illustrate a blank, package, and/or container of a first embodiment of the disclosure.
Figure 2:
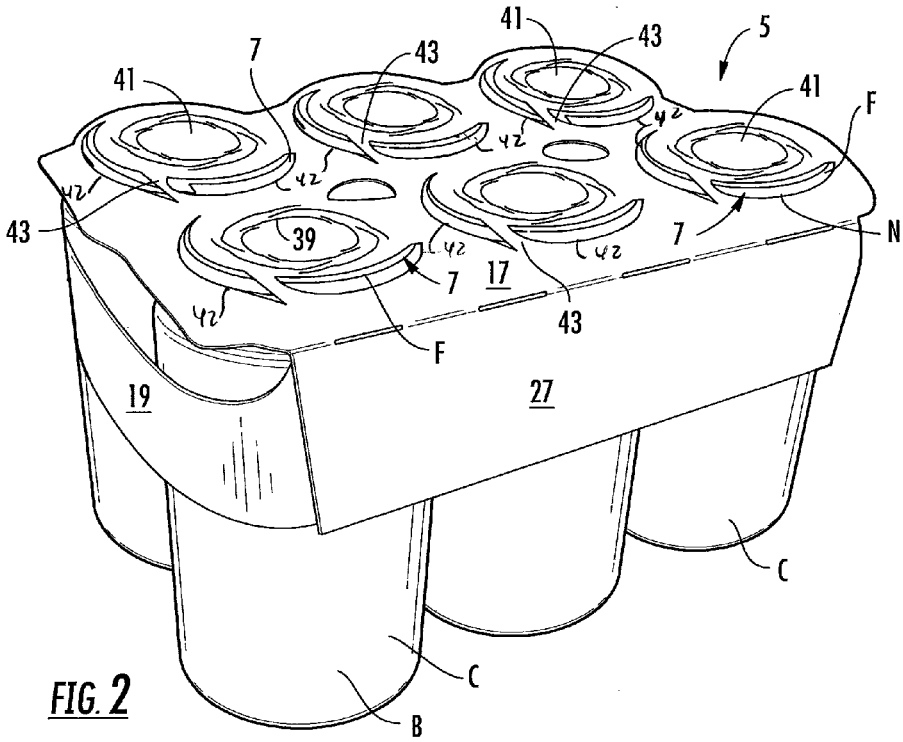

FIG. 1 is a plan view of an exterior side 11 of a blank 13 used to form the package or carrier 5. The blank 13 has a longitudinal axis L1 and a lateral axis L2. The blank 13 comprises a top panel 17 foldably connected to a first end panel 19 at a first lateral tear line 21. The top panel 17 is foldably connected to a second end panel 23 at a second lateral tear line 25. A first side panel 27 is foldably connected to the top panel 17 at a first longitudinal fold line 29. A second side panel 31 is foldably connected to the top panel 17 at a second longitudinal fold line 33.

In the embodiment of FIG. 1, the blank 13 includes six receptacles 37 formed by a series of curved cut lines 39. The receptacles 37 each include a generally circular interior panel 41 that is connected to the top panel 17 by four strips 43 located between the two outermost cut lines 39. The interior panel 41 includes curved fold lines 40 that are spaced inward from the cut lines 39 and help shape the interior panel so the interior panel conforms to the shape of the container C. When the interior panel 41 is raised relative to the top panel 17 the openings 7 in the top panel are formed by the separation of the interior panel 41 from the top panel at the cut lines 39. In the embodiment of FIG. 1, the top panel 17 includes finger holes 47 for grasping and carrying the package 5. Also, the top panel 17 includes curved fold lines 49 between respective pairs of receptacles 37.

The cut lines 39 cooperate to form retention edges 42 (broadly "retention feature") of the opening 7 in the top panel 17 that engages a flange F of the container C. In the illustrated embodiment, each receptacle 37 includes four generally arcuate retention edges that each engage a portion of the flange F of the container C to retain the container in the carton. The retention edges 42 are separated by a respective strip 43 between respective ends of the cuts 39 that attaches the interior panel 41 to the top panel 17.

In the illustrated embodiment, the blank 13 includes end flaps 53, 55 foldably connected to a respective end panel 19, 23 at a longitudinal fold line 57, 59. A gusset panel 61, 63 is respectively connected to the end flaps 53, 55 at a respective oblique fold line 65, 67. Each gusset panel 61, 63 is respectively foldably connected to a side panel 27, 31 at a respective lateral fold line 69, 71.

Figure 3:
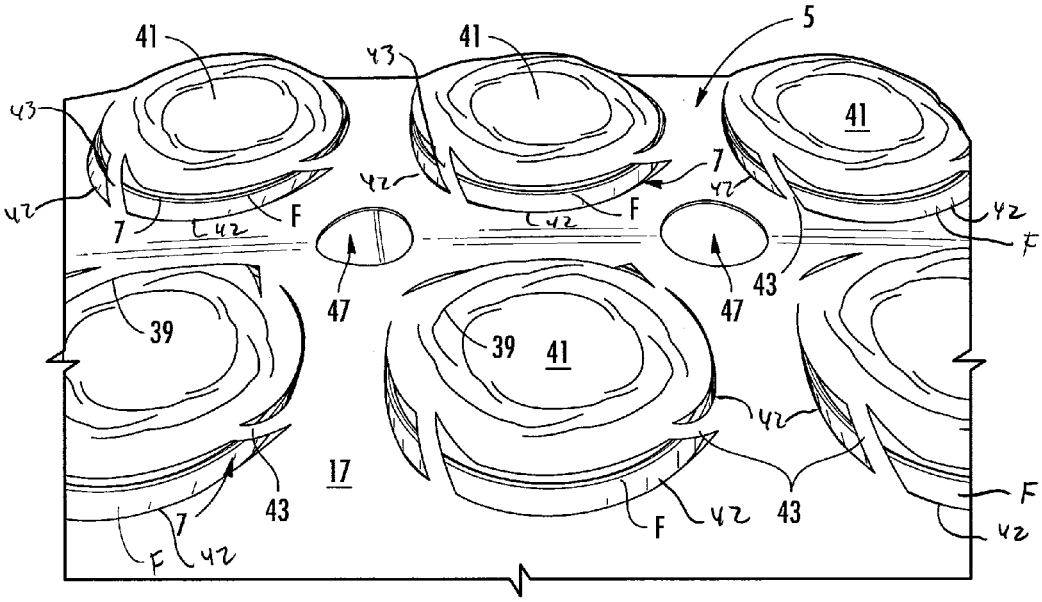
Figure 4:
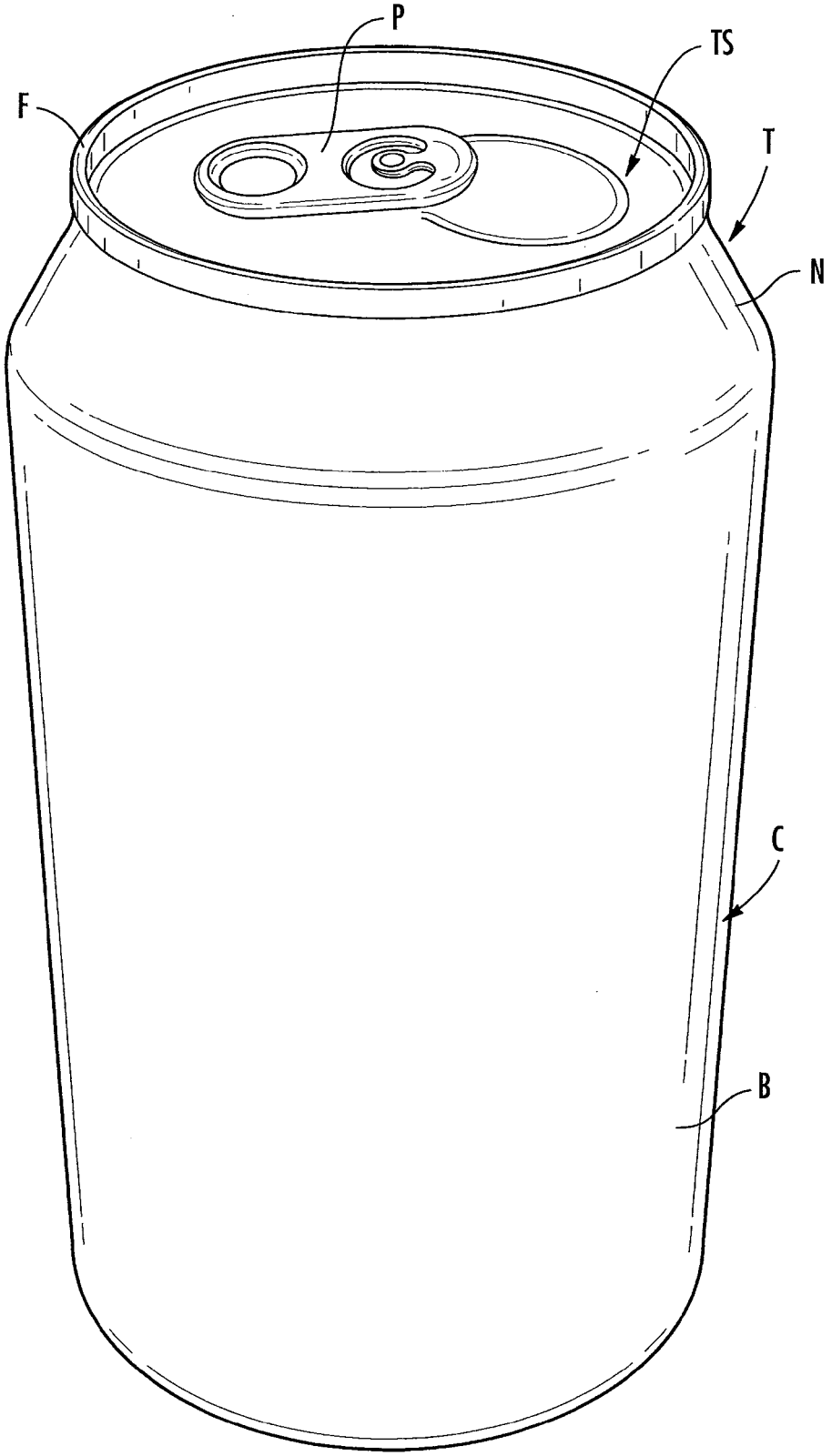

To form the package 50 in accordance with one acceptable method, the containers C are inserted into a respective receptacle 37 so that the top surface of the flanges F of the containers contact the interior panels 41 of the receptacles to raise the interior panels and form the openings 7 in the top panel 17. The flanges F of the containers C are positioned as shown in FIGS. 3 and 4 so that portions (e.g., edges 42) of a respective receptacle 37 adjacent the opening engages the underside of the flange to retains the container in the package 5. The end panels 19, 23 are folded downward relative to the top panel 17 and separated along tear line 21, 25 so that a top edge of the end panels is separated from the top panel. The end flaps 53, 55 are inwardly folded at fold lines 57, 59 and the side panels are downwardly folded at fold lines 29, 33 to form the package 5.

Glue or other adhesive can be applied to one or more of the panels and/or flaps of the blank 13 to secure the package 5 in the folded condition. Also, the package 5 can include handle or reinforcement features as illustrated in U.S. application Ser. No. 12/253,485 filed Oct. 17, 2008, the entire contents of which are incorporated by reference herein for all purposes. Further, the package 5 could include dispensing features for facilitating removal of the containers C from the package. The blank 13 could be otherwise shaped and/or arranged and the package 5 could have features that are otherwise shaped and/or arranged without departing from the disclosure.

Figure 5:
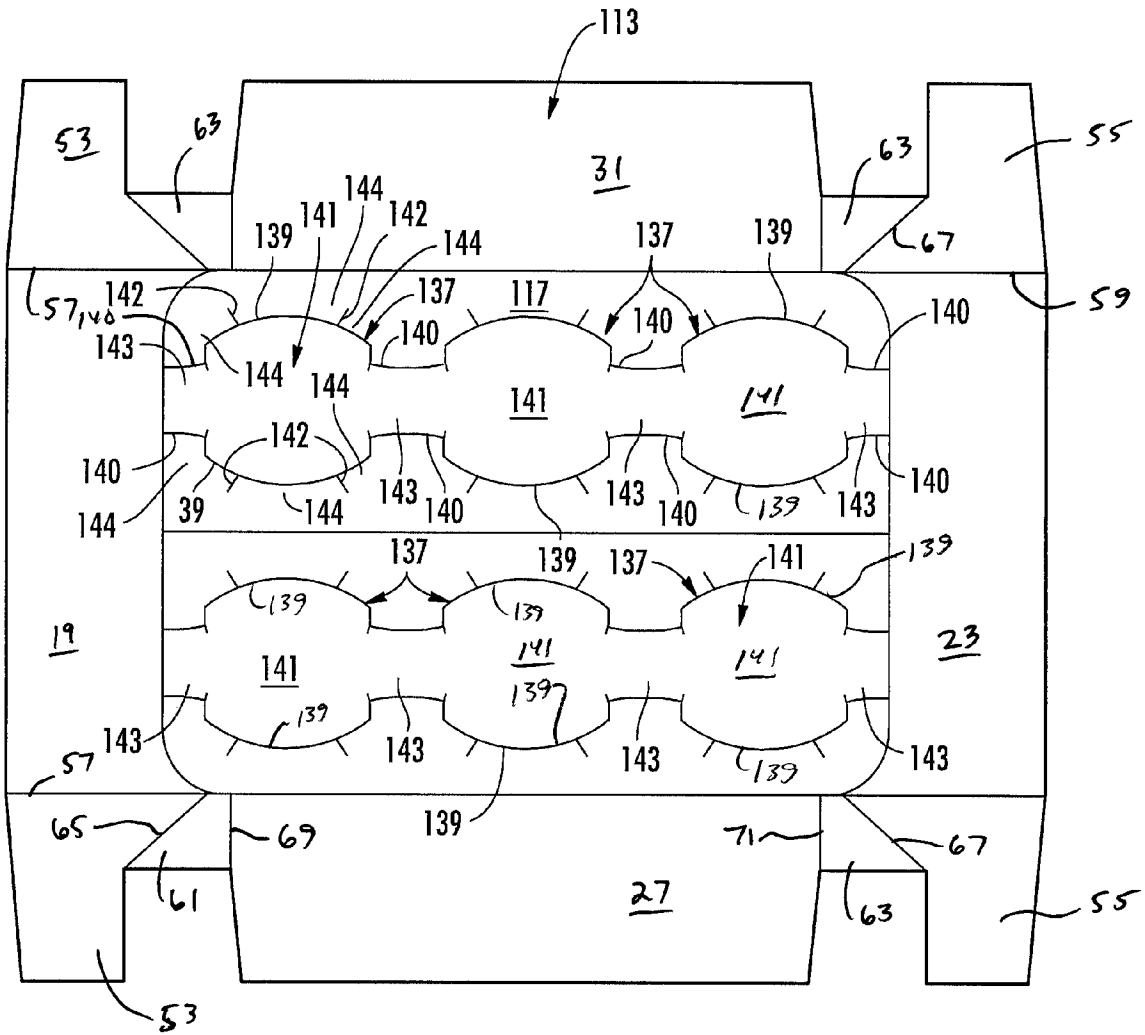
FIGS. 5-7 illustrate a blank and/or a package holding a plurality of containers of a second embodiment of the disclosure.
Figure 6:
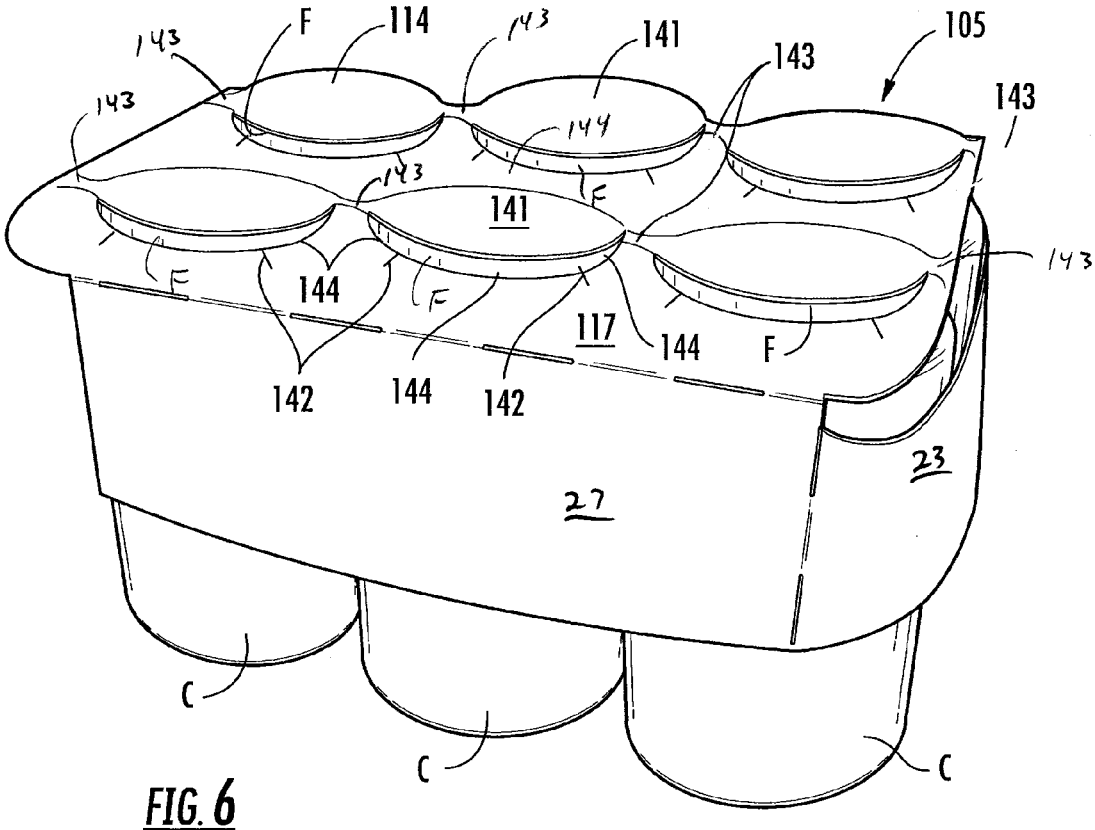
Figure 7:
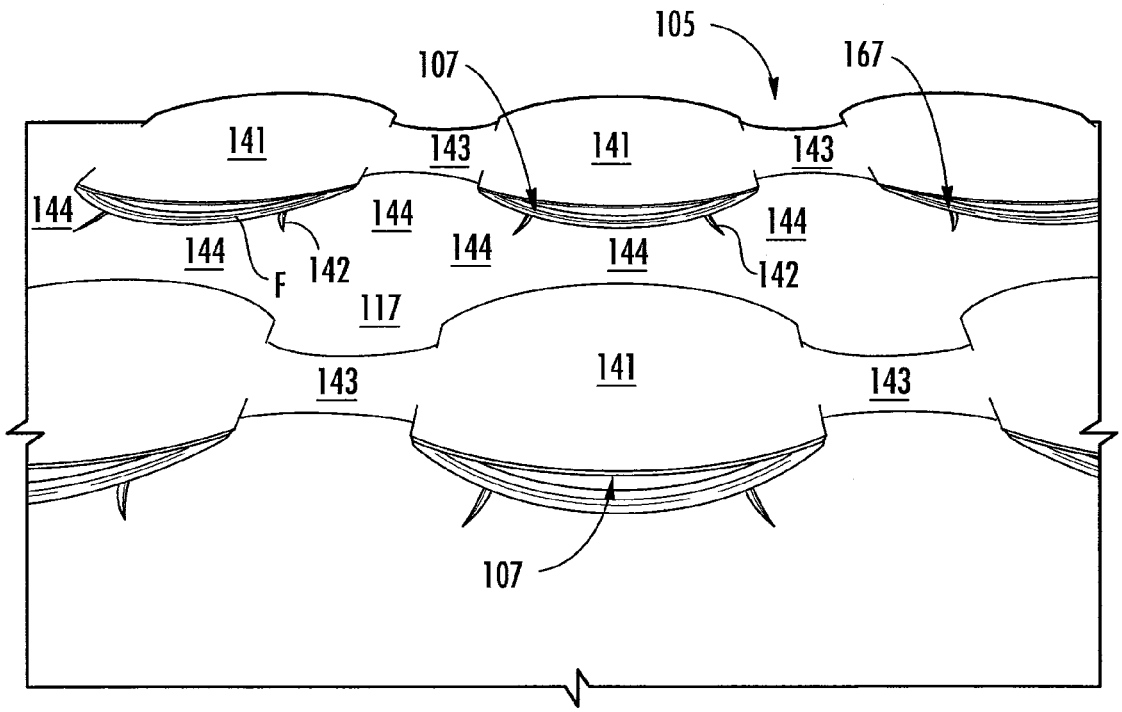

FIGS. 5-7 respectively show a blank 113 and a package 105 of a second embodiment of the disclosure having similar features as the blank 13 and package 5 of the first embodiment. Accordingly, similar or identical features of the embodiments are provided with like reference numbers.

In the embodiment of FIGS. 5-7, the central panels 141 of each of the receptacles 137 remain attached to the top panel 117 by respective tabs 143 at longitudinal ends of the central panels 141. Each of the tabs 143 is defined by the spaced apart ends of cuts 139 forming the central panel 141 of the receptacles 137 and curved fold lines 140 attaching the tabs to the top panel 117. The receptacles 137 include oblique cuts 142 extending from the cuts 139 forming the central panel 141. The oblique cuts 142 form foldable flaps 144 in the top panel 117 that are adjacent the openings 107. The edges of the foldable flaps 144 are defined by the cuts 139 and are for engaging the underside of the flanges F of the containers C. The blank 113 could be otherwise shaped and/or arranged and the package 105 could have features that are otherwise shaped and/or arranged without departing from the disclosure.

Figure 8:
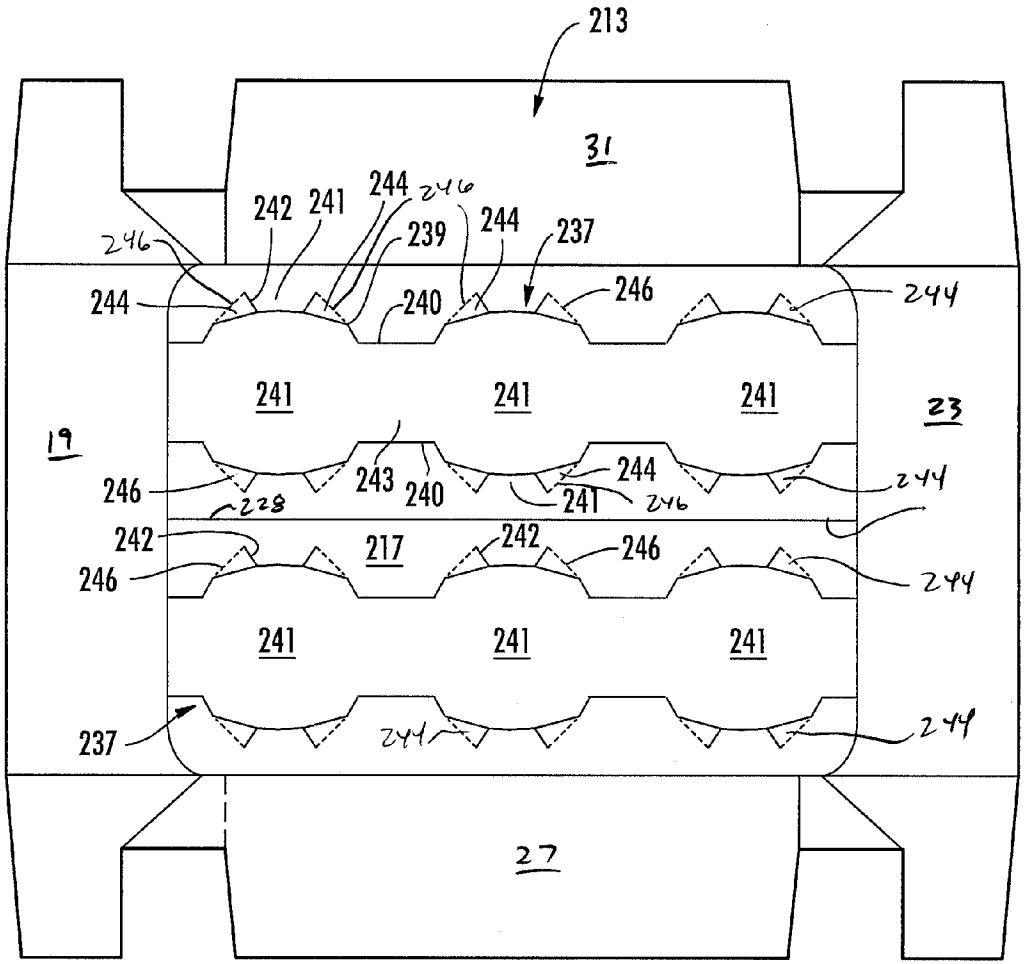
FIGS. 8-10 illustrate a blank and/or a package holding a plurality of containers of a third embodiment of the disclosure.
Figure 9:
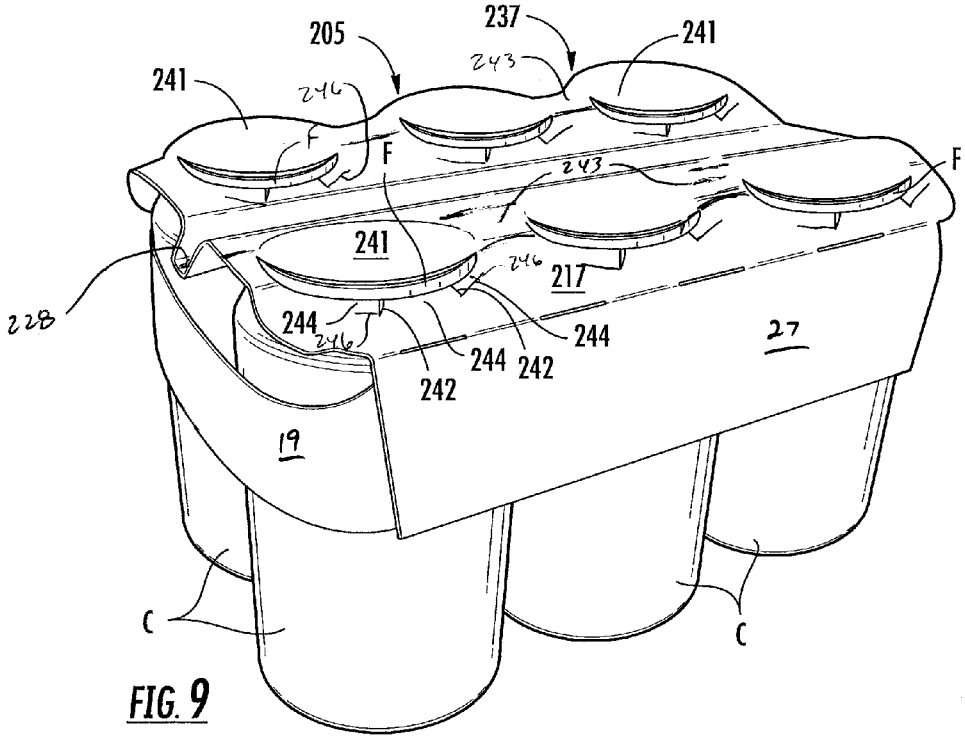
Figure 10:
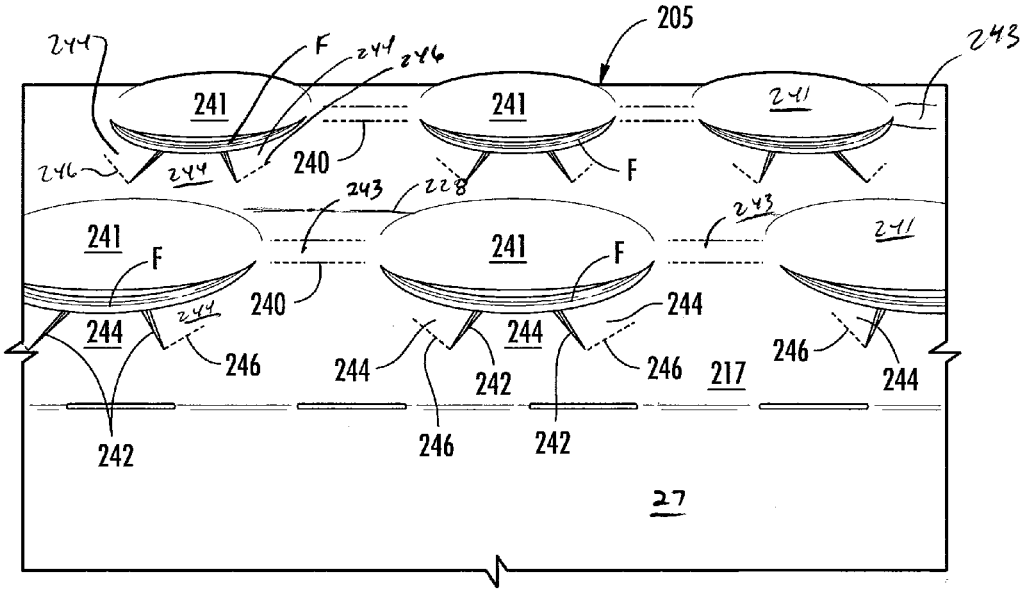

FIGS. 8-10 show a blank 213 for forming a package 205 of a third embodiment of the disclosure having similar features as the blank and packages of the previous embodiments. Accordingly, similar or identical features of the embodiments are provided with like reference numbers.

The blank 213 includes a top panel 217 having receptacles 237 similar to the receptacles 137 of the previous embodiment. In the embodiment of FIGS. 8-10, the central panels 241 are similarly shaped as the central panels 141. The foldable flaps 244 are formed by the oblique cuts 242. In the embodiment of FIGS. 8-10, the foldable flaps 244 are at least partially defined by oblique fold lines 246 that extend between the oblique cuts 242 and the cuts 139 defining the central panel 241. In the embodiment of FIGS. 8-10, the tabs 243 are formed by generally straight fold lines 240. In one embodiment, the top panel 217 includes a longitudinal fold line 228 that extends across the length of the top panel. The fold line 228 facilitates forming the package 205 and allows the top panel 217 to conform to the shape of the containers C. The blank 213 could be otherwise shaped and/or arranged and the package 205 could have features that are otherwise shaped and/or arranged without departing from the disclosure.

Figure 11:
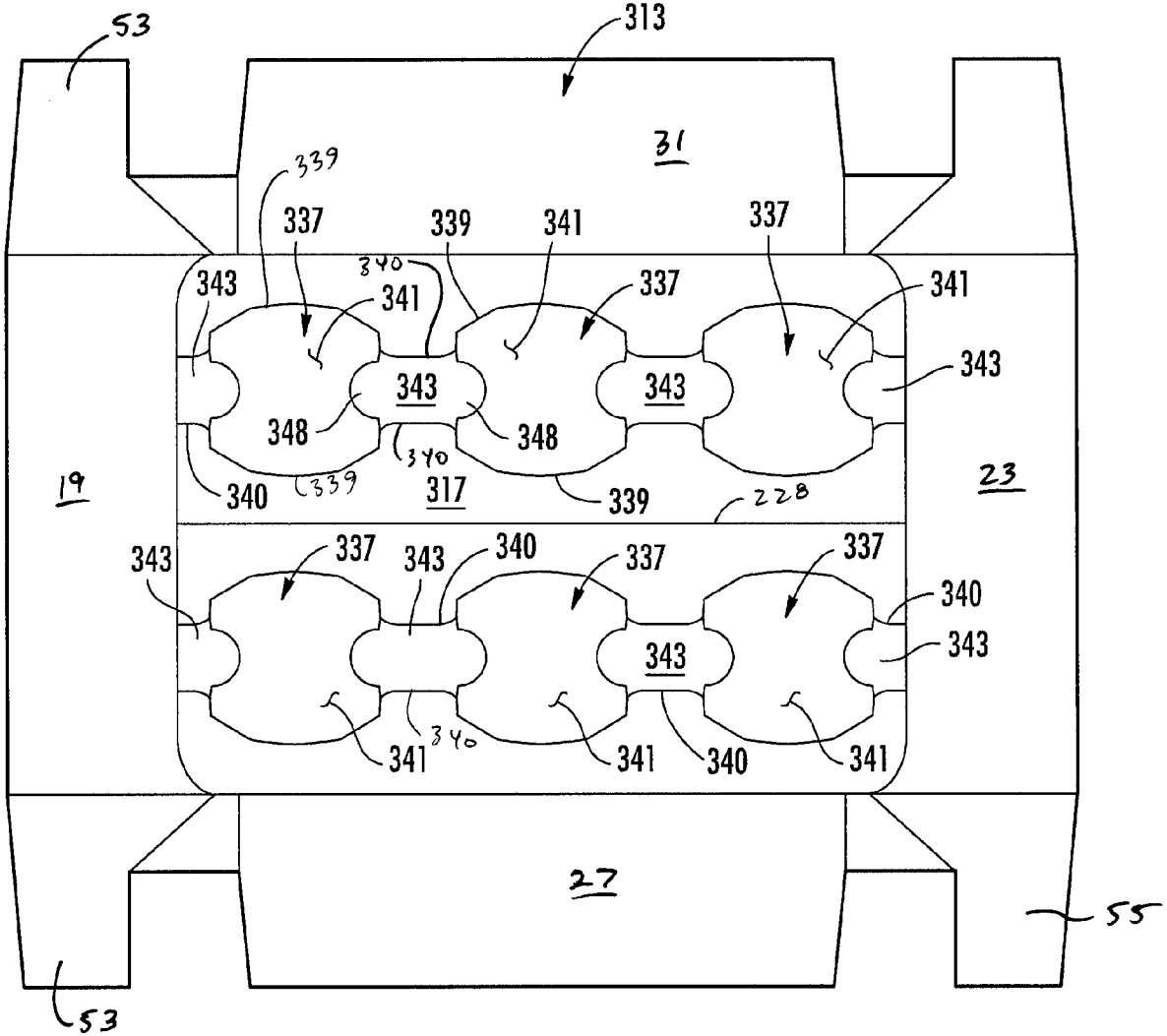
FIGS. 11-13 illustrate a blank and/or a package holding a plurality of containers of a fourth embodiment of the disclosure.
Figure 12:
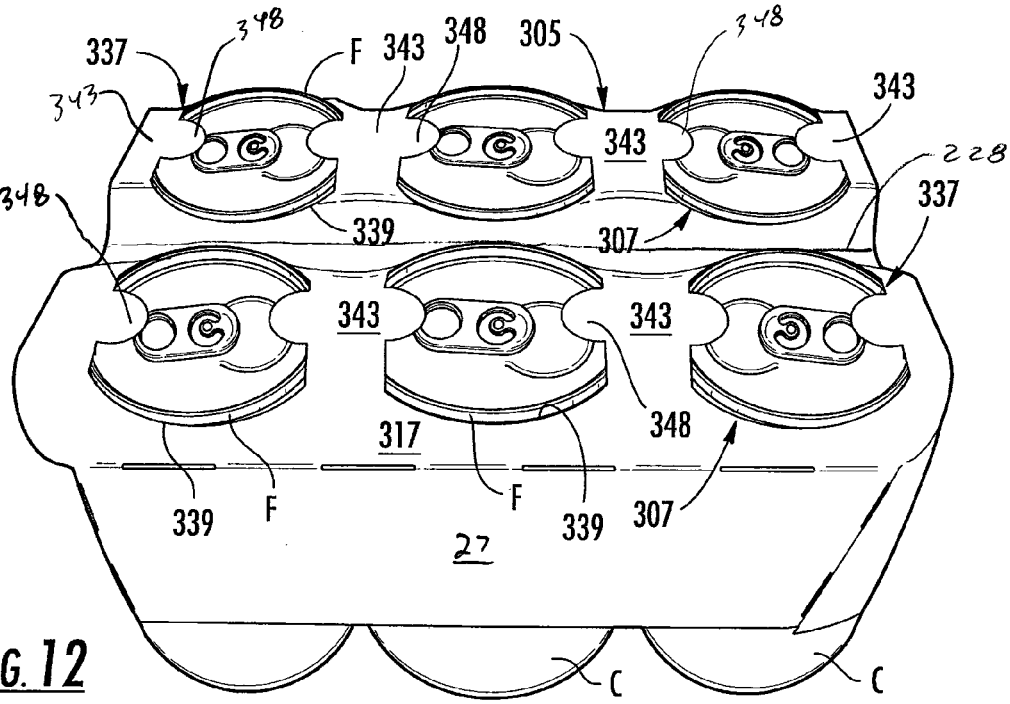
Figure 13:
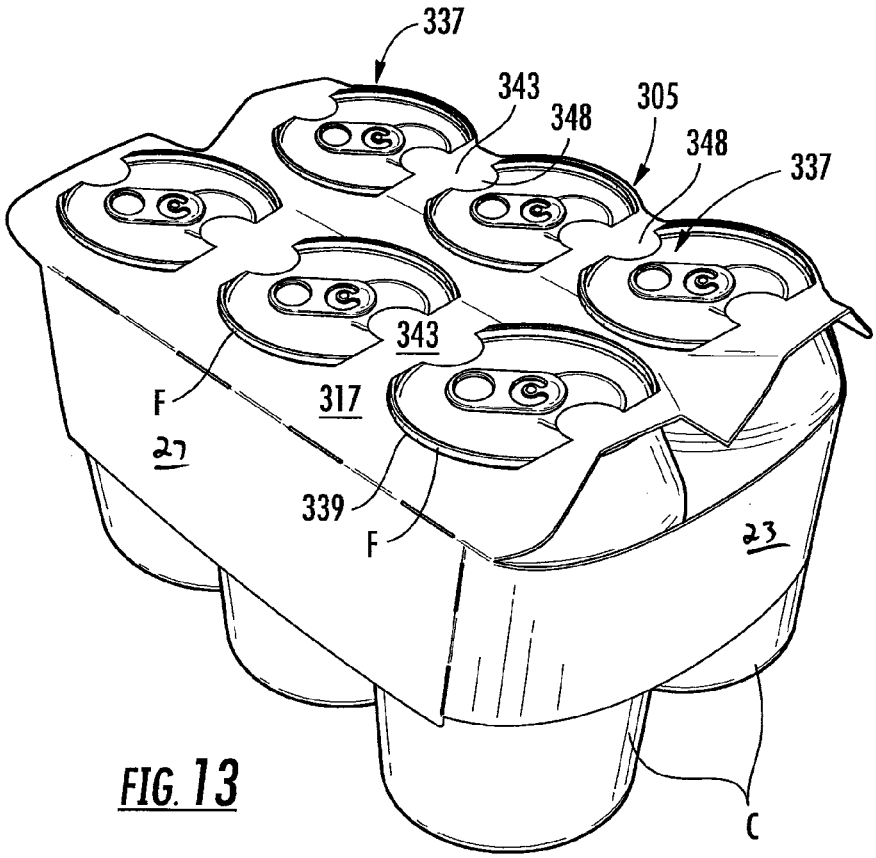

FIGS. 11-13 show a blank 313 for forming a package 305 of a fourth embodiment of the disclosure having similar features as the blank and packages of the previous embodiments. Accordingly, similar or identical features of the embodiments are provided with like reference numbers.

The blank 313 includes receptacles 337 that have openings 341 in the top panel 317. The receptacles 337 include tabs 343 adjacent respective longitudinal sides of the openings 341. The tabs 343 are defined by curved fold lines 340 in the top panel. The openings 341 have curved edges 339, formed by correspondingly shaped curved cuts lines in the blank 313, that extend generally in the longitudinal direction L1. As shown in FIGS. 12 and 13, the curved edges 339 engage an underside of the flange F of a respective container to retain the containers in the package 305. The tabs 343 include protruding portions 348 that are generally semi-circular shaped and located between the curved edges 339. In the illustrated embodiment, the protruding portions 348 of the tabs 343 are in contact with a top surface of the flange F of the containers C and are spaced apart from the top panel 317 of the package 305. The blank 313 could be otherwise shaped and/or arranged and the package 305 could have features that are otherwise shaped and/or arranged without departing from the disclosure.

Figure 14:
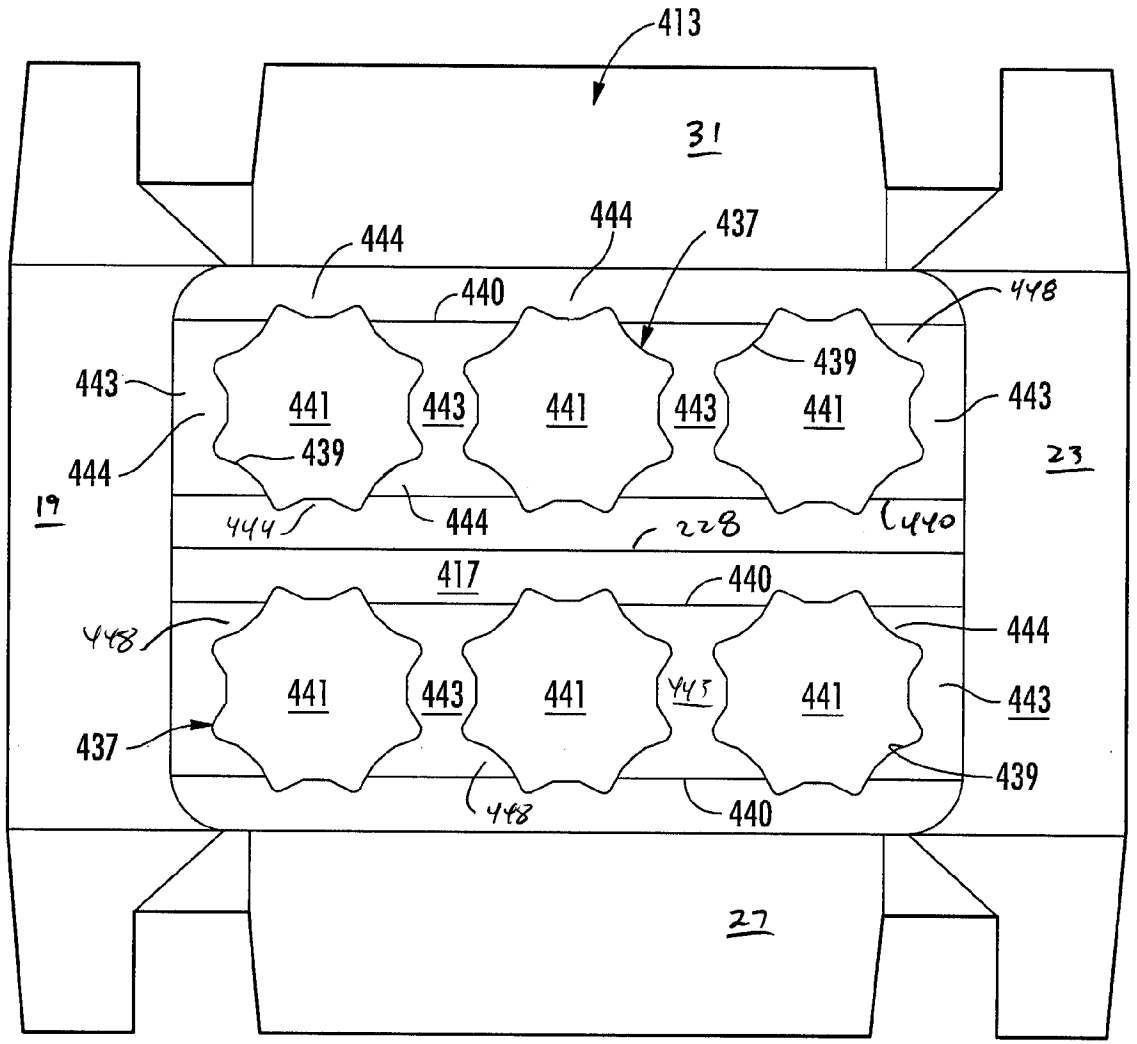
FIGS. 14-16 illustrate a blank and/or a package holding a plurality of containers of a fifth embodiment of the disclosure 5.
Figure 15:
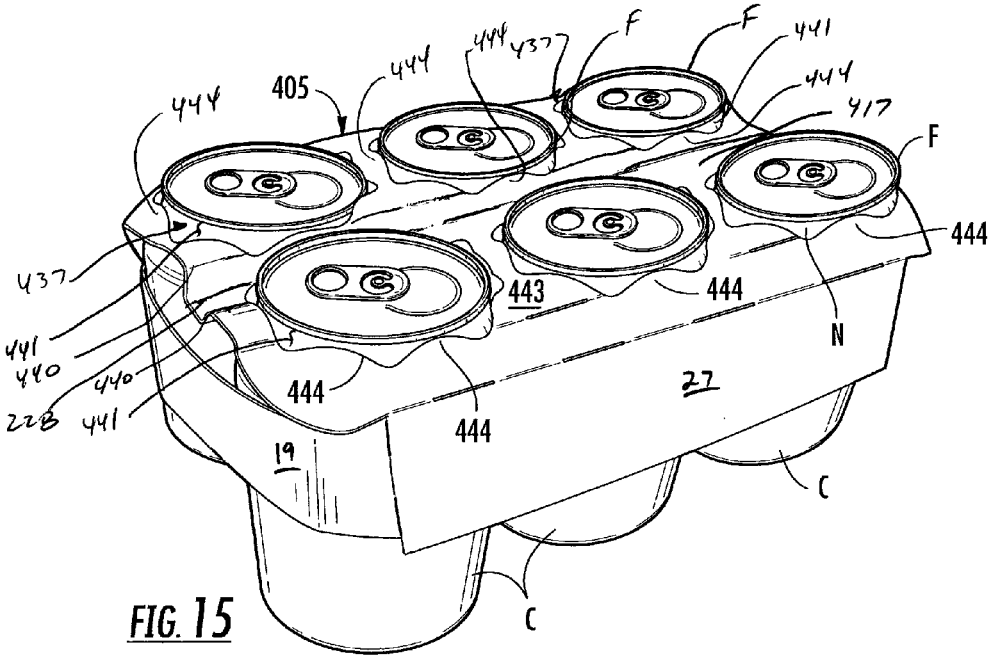
Figure 16:
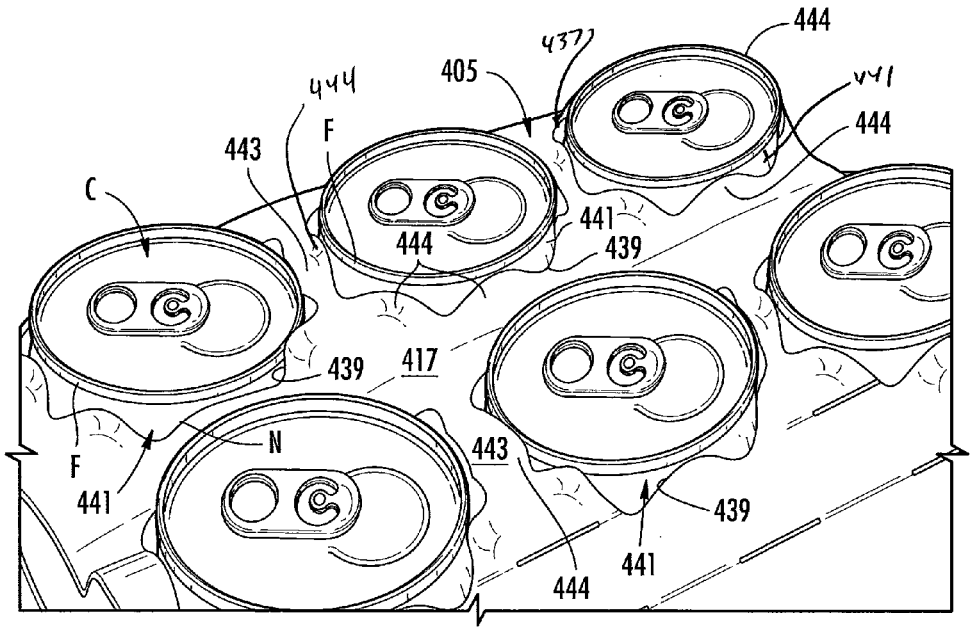

FIGS. 14-16 show a blank 413 for forming a package 405 of a fifth embodiment of the disclosure having similar features as the blank and packages of the previous embodiments. Accordingly, similar or identical features of the embodiments are provided with like reference numbers.

The blank 413 includes receptacles 437 that have openings 441 in the top panel 417. The openings 441 are generally star-shaped and are formed by respective edges 439. The edges 439 of the openings 441 have curved portions that form respective foldable flaps 444 that are adjacent the openings 441. The foldable flaps 444 protrude into a respective opening 441 and engage an underside of a respective flange F of the containers C. The tabs 443 between the openings 441 are defined by longitudinal fold line 440. In the illustrated embodiment, each receptacle 437 includes eight foldable flaps 444. The blank 413 could be otherwise shaped and/or arranged and the package 405 could have features that are otherwise shaped and/or arranged without departing from the disclosure.

Figure 17:
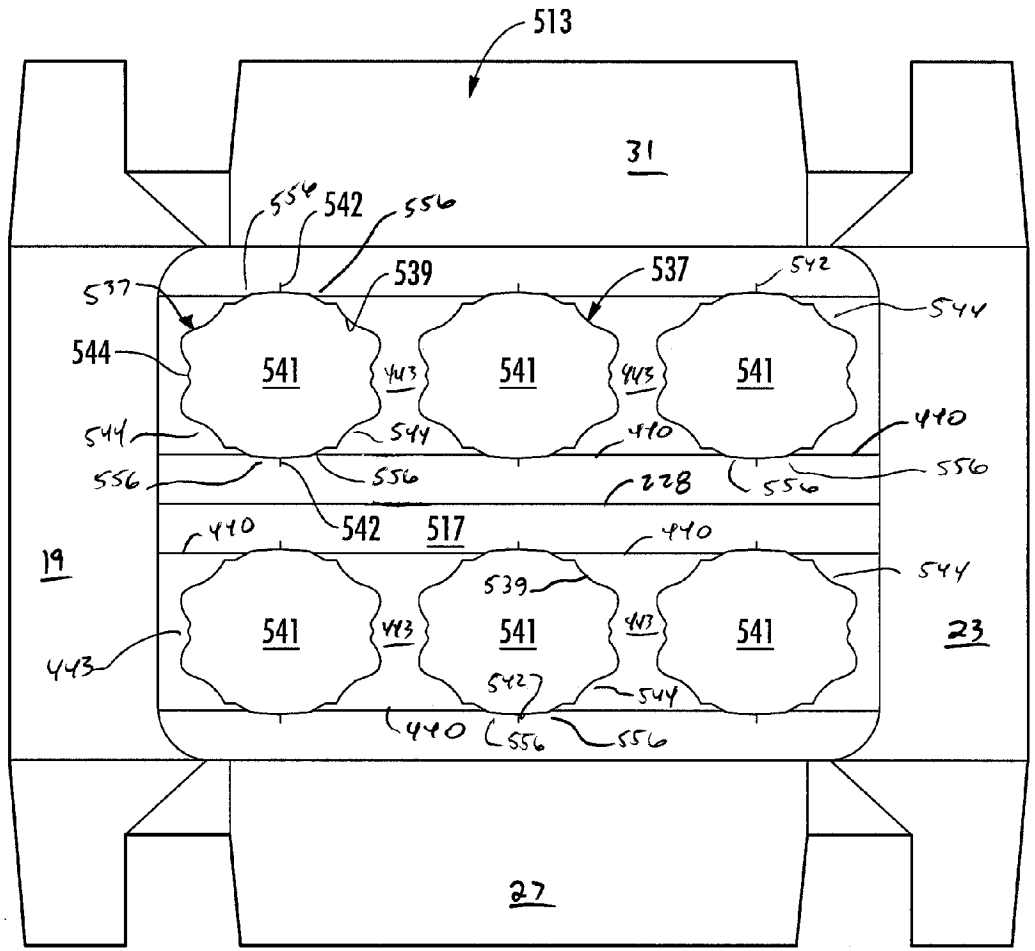
FIGS. 17-19 illustrate a blank and/or a package holding a plurality of containers of a sixth embodiment of the disclosure Corresponding parts are designated by corresponding reference numbers throughout the drawings.
Figure 18:
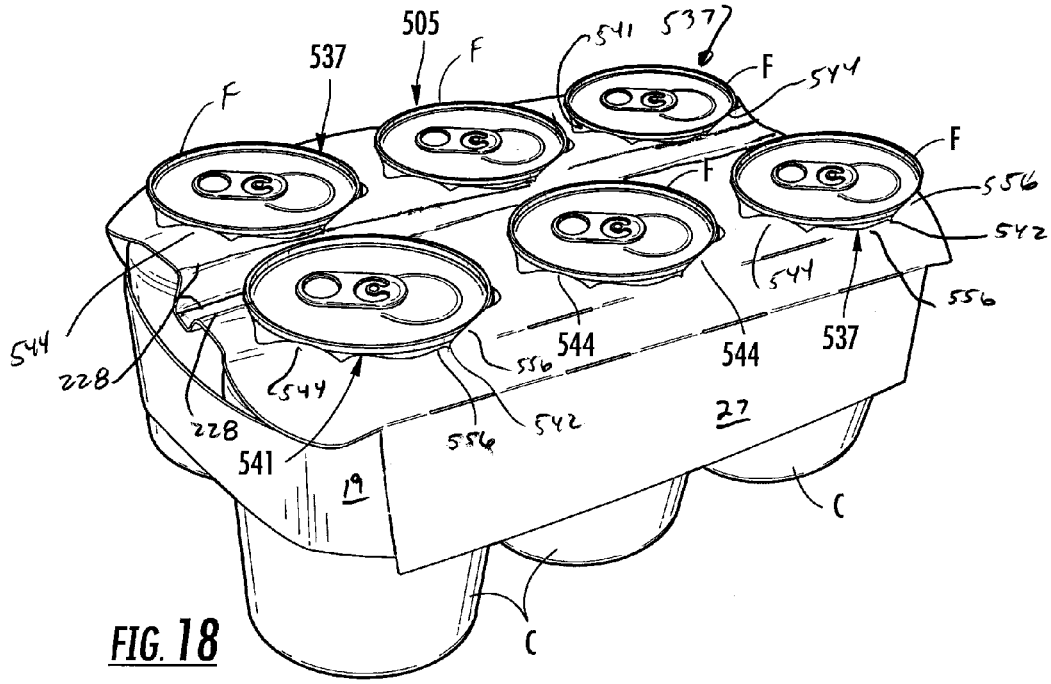
Figure 19:
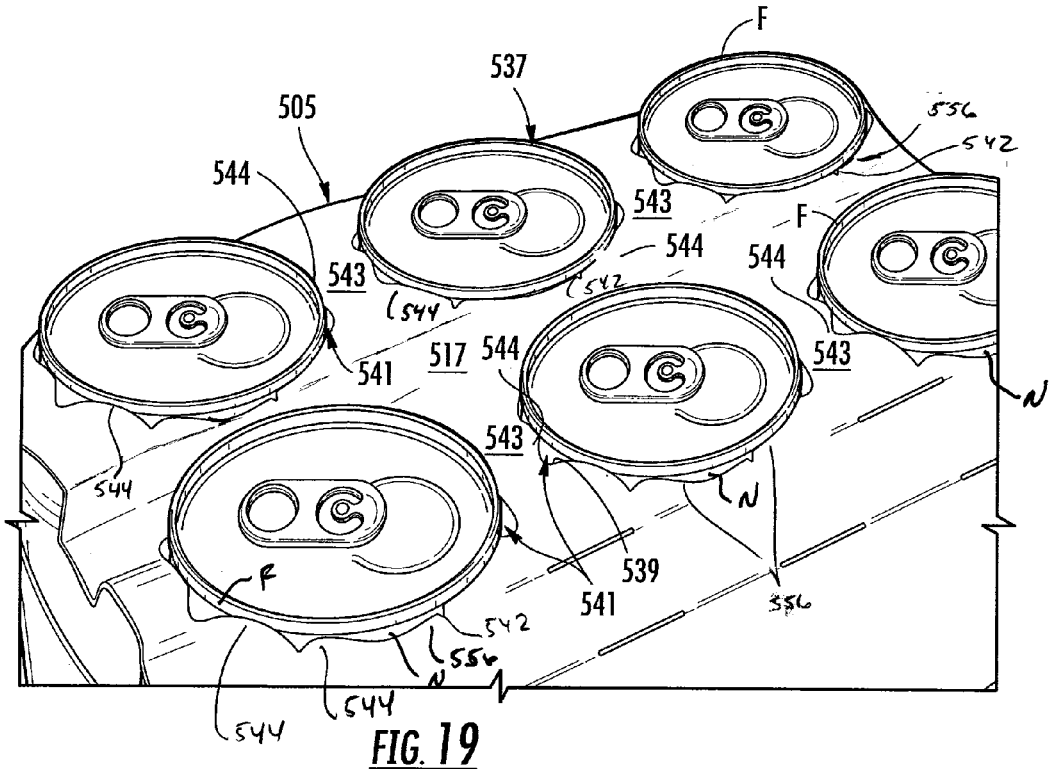

FIGS. 17-19 show a blank 513 for forming a package 505 of a sixth embodiment of the disclosure having similar features as the blank and packages of the previous embodiments. Accordingly, similar or identical features of the embodiments are provided with like reference numbers.

The blank 513 includes receptacles 537 similar to the receptacles 437 of the previous embodiment. The openings 541 have an edge 539 that is similar in shape as the edge 439 of the previous embodiment. Foldable flaps 544 are formed by portions of the edge 539 adjacent the opening 541. The foldable flaps 544 protrude into a respective opening 541 and engage an underside of a respective flange F of the containers C. In the embodiment of FIGS. 17-19, the blank 513 comprises retention flaps 556 adjacent the opening 541 that are formed by lateral cuts 542. The retention flaps 556 do not protrude into the opening 541 so that the retention flaps engage the neck N of the containers at a location spaced below the underside of the flange F. The retention flaps 556 provide additional attachment force that secures the package 505 to the containers C. In the embodiment of FIGS. 17-19, the package has six foldably flaps 544 adjacent each opening 541 that engage the underside of the flange F and four retention flaps 556 adjacent each opening that engage the neck N of a respective container C. The blank 513 could be otherwise shaped and/or arranged and the package 505 could have features that are otherwise shaped and/or arranged without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a plurality of containers, the package comprises:

panels that extend at least partially around an interior of the package, the panels comprise a top panel and at least one side panel foldably connected to the top panel;

at least one feature in the top panel that receives and holds a top portion of at least one container of the plurality of containers, the at least one feature comprises an opening in the top panel, a retention panel spaced apart from the opening, and a retention feature adjacent the opening to engage at least one container of the plurality of containers to at least partially attach the at least one container to the package;

wherein the retention panel is connected to the top panel by a strip of material extending from the opening to the retention panel, and at least a portion of the retention panel is generally parallel with the top panel;

wherein the retention feature comprises a retention portion of the top panel adjacent the opening, the retention portion of the top panel being in contact with an underside of a flange of the at least one container, and the retention portion of the top panel being generally planar with a remainder of the top panel.

2. The package of claim 1 wherein the opening is formed by spaced apart cut lines.

3. The package of claim 2 wherein the spaced apart cut lines are curved cut lines that conform to a shape of the at least one container.

4. The package of claim 2 wherein the top panel has arcuate retention edges adjacent to the opening.

5. The package of claim 2 wherein the retention panel contacts an uppermost surface of the at least one container.

6. The package of claim 1 wherein the opening has a curved edge.

7. A blank for forming a package for holding a plurality of containers, the blank comprises:

panels that comprise a top panel and at least one side panel foldably connected to the top panel, the panels are from forming an interior of the package formed from the blank;

at least one feature in the top panel that is for receiving and holding a top portion of at least one container of the plurality of containers in the package formed from the blank, the at least one feature comprises an opening in the top panel in the package formed from the blank, a retention panel for being spaced apart from the opening when the package is formed from the blank, and a retention feature adjacent the opening for engaging the at least one container of the plurality of containers to at least partially attach the at least one container to the package;

wherein the retention panel is connected to the top panel by a strip of material for extending from the opening to the retention panel when the carton is formed from the blank, and at least a portion of the retention panel is for being generally parallel with the top panel when the carton is formed from the blank;

wherein the retention feature comprises a retention portion of the top panel adjacent the opening, the retention portion of the top panel is for being in contact with an underside of a flange of the at least one container in the package formed form the blank, and the retention portion of the top panel is for being generally planar with a remainder of the top panel when the package is formed from the blank.

8. The blank of claim 7 wherein the opening is formed by spaced apart cut lines.

9. The blank of claim 8 wherein the retention panel is for contact with an uppermost surface of the at least one container.

10. A method of forming a package for containing a plurality of containers, the method comprising:

providing a blank having a top panel and at least one side panel foldably connected to the top panel, at least one feature in the top panel that comprises an opening in the top panel, a retention panel, and a retention feature adjacent the opening; and inserting at least a top portion of a container through the opening and engaging the top portion of the container with the retention feature to at least partially attach the container to the package;

wherein the retention panel is foldably connected to the top panel along a strip of material, the inserting at least a top portion of the container comprises spacing the retention panel apart from the opening so that at least a portion of the retention panel is generally parallel with the top panel, the strip of material extending from the opening to the retention panel;

wherein the retention feature comprises a portion of the top panel adjacent the opening, the portion of the top panel being generally planar with a remainder of the top panel, the inserting the at least a portion of a container comprises placing the portion of the top panel in contact with an underside of a flange of the container.

11. The method of claim 10 wherein the inserting at least a top portion of the container comprises placing an uppermost surface of the container into contact with the retention panel.

12. The method of claim 10 wherein the opening is a first opening, the at least one retention feature is a first retention feature, and the container is a first container, the blank comprises a second opening and a second retention feature adjacent the second opening, the method further comprises inserting at least a portion of a second container through the second opening and engaging the top portion of the second container with the second retention feature to at least partially attach the second container to the package.

13. The package of claim 1, wherein the retention panel is connected to the top panel by a plurality of strips of material extending from the opening to the retention panel.

14. The package of claim 13, wherein each strip of the plurality of strips of material is connected to an edge of the opening adjacent the retention portion of the top panel.

15. The package of claim 13, wherein each strip of the plurality of strips of material comprises two free edges.

16. The package of claim 1, wherein the retention portion of the top panel is a first retention portion of the top panel and the retention feature further comprises a second retention portion of the top panel adjacent the opening and spaced apart from the first retention portion of the top panel, the second retention portion of the top panel is in contact with an underside of the flange of the at least one container, and the second retention portion of the top panel is generally planar with a remainder of the top panel.

17. The package of claim 16, wherein the strip of material extends from the opening adjacent the first retention portion of the top panel and the second retention portion of the top panel.

18. The package of claim 17, wherein the strip of material comprises a first strip edge and a second strip edge, the first strip edge extending from a first retention edge of the first retention portion of the top panel, and the second strip edge extending from an end of a second retention edge of the second retention portion of the top panel, the first strip edge being collinear with the first retention edge.

19. The package of claim 18, wherein;

the strip of material is a first strip of material and the retention panel is further connected to the top panel by a second strip of material;

the retention feature further comprises a third retention portion of the top panel adjacent the opening and spaced apart from the first retention portion of the top panel and the second retention portion of the top panel, the third retention portion of the top panel is in contact with an underside of the flange of the at least one container, and the third retention portion of the top panel is generally planar with a remainder of the top panel; and the second strip of material comprises a third strip edge and a fourth strip edge, the third strip edge extending from the second retention edge of the second retention portion of the top panel, and the fourth strip edge extending from an end of a third retention edge of the third retention portion of the top panel, the third strip edge being collinear with the second retention edge.

20. The blank of claim 7, wherein the retention panel is connected to the top panel by a plurality of strips of material for extending from the opening to the retention panel when the package is formed from the blank.

21. The blank of claim 20, wherein each strip of the plurality of strips of material is connected to an edge of the opening adjacent the retention portion of the top panel in the package formed from the blank.

22. The blank of claim 20, wherein each strip of the plurality of strips of material is at least partially defined by a portion of a first cut line and a portion of a second cut line, and, for each strip of the plurality of strips of material, the portion of the first cut line and the portion of the second cut line form respective free edges of the strip in the package formed from the blank.

23. The blank of claim 7, wherein the retention portion of the top panel is a first retention portion of the top panel and the retention feature further comprises a second retention portion of the top panel adjacent the opening and spaced apart from the first retention portion of the top panel, the second retention portion of the top panel is for being in contact with an underside of the flange of the at least one container in the package formed from the blank, and the second retention portion of the top panel is for being generally planar with a remainder of the top panel when the package is formed from the blank.

24. The blank of claim 23, wherein the strip of material extends from the opening adjacent the first retention portion of the top panel and the second retention portion of the top panel when the package is formed from the blank.

25. The blank of claim 24, wherein:

the strip of material is at least partially defined by a portion of a first cut line and a portion of a second cut line for respectively forming a first strip edge and a second strip edge in the package formed from the blank;

at least a portion of the first cut line is for forming a first retention edge of the first retention portion of the top panel at the opening in the package formed from the blank, and at least a portion of the second cut line is for forming a second retention edge of the second retention portion of the top panel at the opening in the package formed from the blank.

26. The blank of claim 25, wherein at least a portion of the first cut line and at least a portion of the second cut line each defines a portion of the retention panel.

27. The blank of claim 25, wherein each of the first cut line and the second cut line is an arcuate cut line.

28. The blank of claim 25, wherein;

the retention feature further comprises a third retention portion of the top panel adjacent the opening and spaced apart from the first retention portion of the top panel and the second retention portion of the top panel, the third retention portion of the top panel is for being in contact with an underside of the flange of the at least one container in the package formed from the blank, and the third retention portion of the top panel is for being generally planar with a remainder of the top panel when the package is formed from the blank;

the strip of material is a first strip of material and the retention panel is further connected to the top panel by a second strip of material, the second strip of material being at least partially defined by a portion of the second cut line and a portion of a third cut line for respectively forming a third strip edge and a fourth strip edge in the package formed from the blank; and at least a portion of the third cut line is for forming a third retention edge of the third retention portion of the top panel at the opening in the package formed from the blank.

* * * * *